US010123591B2

(12) United States Patent
Angelini et al.

(10) Patent No.: US 10,123,591 B2
(45) Date of Patent: Nov. 13, 2018

(54) SAFETY BUCKLE WITH PROVISION FOR EMERGENCY RELEASE

(71) Applicant: MARES S.P.A., Rapallo (GE) (IT)

(72) Inventors: Sergio Angelini, Chiavari (IT); Luciano Avataneo, Rapallo (IT)

( * ) Notice: Subject to any disclaimer, the term of this patent is extended or adjusted under 35 U.S.C. 154(b) by 175 days.

(21) Appl. No.: 14/912,163

(22) PCT Filed: Aug. 6, 2014

(86) PCT No.: PCT/EP2014/066873

§ 371 (c)(1),
(2) Date: Feb. 16, 2016

(87) PCT Pub. No.: WO2015/024777

PCT Pub. Date: Feb. 26, 2015

(65) Prior Publication Data

US 2016/0198808 A1 Jul. 14, 2016

(30) Foreign Application Priority Data

Aug. 21, 2013 (IT) ..... GE2013A0083

(51) Int. Cl.

| | |
|---|---|
| ***A41D 13/012*** | (2006.01) |
| ***B63C 11/30*** | (2006.01) |
| ***A44B 11/26*** | (2006.01) |
| ***A44B 11/25*** | (2006.01) |

(52) U.S. Cl.

CPC ..... *A44B 11/26* (2013.01); *A41D 13/0125* (2013.01); *A44B 11/2592* (2013.01); *B63C 11/30* (2013.01); *B63C 2011/303* (2013.01); *B63C 2011/306* (2013.01)

(58) Field of Classification Search

CPC ... A44B 11/266; A44B 11/26; A44B 11/2592; Y10T 24/45487; Y10T 24/45529; Y10T 24/45534; Y10T 24/45628; Y10T 24/45634; Y10T 24/45681; Y10T 24/45696; Y10T 24/45702; Y10T 24/45712; B63C 2011/306; B63C 2011/303

See application file for complete search history.

(56) References Cited

U.S. PATENT DOCUMENTS

2003/0150088 A1 8/2003 Turpin
2005/0074295 A1 4/2005 Kawashima

FOREIGN PATENT DOCUMENTS

EP 1864586 A2 12/2007

*Primary Examiner* — Jack W Lavinder
(74) *Attorney, Agent, or Firm* — Themis Law

(57) ABSTRACT

A device for releasably connecting a first element with a second element includes a male element connectable to one end of the first element, and a female element connectable to one end of the second element such that the male and female element pass from a disengagement condition to a mutual engagement condition. A slider activates and deactivates engagement and is engaged to the male element such to slide along the axis of insertion of the male element inside the female element. The relative motion between the activation/deactivation slider and the male element is transmitted to first removable locking members, belonging to the male element and cooperating with corresponding second locking members belonging to the female element, such to pass from a stable locking condition to a stable release condition of the male and female elements via a movement of the slider along the axis of insertion.

7 Claims, 11 Drawing Sheets

SAFETY BUCKLE WITH PROVISION FOR EMERGENCY RELEASE

The present invention relates to a device for releasably connecting a first element to a second element, which elements are alternately connectable and disconnectable comprising a male element connectable to one end of said first element.

The male element is inserted into a female element connectable to one end of said second element, such that the male element and the female element pass from a disengagement condition to a mutual engagement condition, there being provided a slider activating/deactivating the engagement condition, which is engaged to the male element in a manner slidable along the axis of insertion of the male element into the female element.

The device of the present invention relates to all "quick-release" devices, such as for example buckles, that allow two elements to be coupled and/or released in an easy and quick manner.

A possible application of such devices is the diving field, namely for connecting devices used for connecting a weight pouch to a pocket of a diving jacket.

The jackets intended for divers are equipped with pockets adapted to contain ballast elements, intended to facilitate the immersion.

These ballasts are not directly inserted into the pockets of the jacket, but generally they are collected into pouches, till reaching the weight selected by the diver. The pouch, generally containing one or more ballasts, therefore is inserted into the pocket of the jacket and it has to be fastened to the diver's jacket by means of a releasable connecting device. The connecting device of such ballast system has to provide two important properties: an easy removal of the ballast in case of emergency (an intuitive movement that does not involve a particular concentration but which takes place automatically) as well as the impossibility of being accidentally removed (since it would lead to an uncontrolled ascent of the diver which would cause embolism or decompression sickness). Moreover it is favorable to provide the pouch containing the ballast to be easily inserted and removed when dressing and undressing.

The connection devices known in the prior art are generally composed as described above, that is a male element connected to a pouch containing the ballasts, inserted into a female element integral with the diver's jacket.

The releasable connection devices as a consequence have to prevent the pouch from accidentally falling out from the pocket of the jacket and have to allow it to be easily removed when the diver has to carry out an emergency ascent. An easy insertion and removal are further desirable in order to facilitate the so called donning and doffing phases that is the phases of dressing and undressing the divers' jacket.

Moreover the releasable connection device has to provide components easy to be handled, since the diver may wear thick gloves that can limit the easiness of moving the fingers, preventing fine and accurate movements, and they limit the tactile sensitivity.

Based on such requirements, there are many documents describing several configurations used by the devices known in the prior art.

For example the document EP 1520780 describes a device for releasing weight pouches composed of a flexible band fixed, on one side, to the weight pouch and, on the other side, to the middle of a rigid blade element which is introduced into the buckle fastened on the sides of the compensator vest. The blade element at the opposite end has a handle for facilitating the gripping.

The buckle on the vest is composed of a movable eccentric lever that in the closing position, by means of indentations provided on the blade element, allows the pouches to be fastened into containers arranged on the sides of the vest.

By pulling the handle fastened to the weight pouches the lever of the buckle raises, the blade element slides in the buckle and it allows the pouches to be removed from the vest.

Therefore the document shows a ballast pouch to be inserted into a side pocket of the vest, which is connected to a male element intended to be inserted into a buckle placed on the outer side wall of the vest by means of a band, but, since the pockets are placed outside the field of vision of the diver, the releasing device described above facilitates the release of the weights but it makes almost impossible to position the weights when the vest is worn.

Another solution is described in the document EP1864586 providing a device comprising a female element wherein a male element is engaged by a snap action which is composed a cap and a latch. By exerting a pulling action, by a band and a handle on the cap the arms of the latch are bent, allowing the male element to be removed from the sheath and then allowing the weights to be removed from the pocket.

However the positioning of the female element into the weight pouch can make it difficult to insert the weights in the pocket and the male element in the female element.

In addition to the documents mentioned above, the devices known in the prior art generally are characterized by the use of buckles with traditional hooking mechanism, that is with teeth on the male element engaging with suitable seats in the female element followed by a deformation of the arms on which they are mounted, and the engagement being accomplished by a real locking of the tooth into the corresponding seat. Such coupling cannot be always guaranteed, for example due to the wear of the teeth of the male element or due to a loss in the elasticity and therefore in the movement of the arms on which the hooking teeth are positioned.

There are also prior art known devices generally characterized by complicated arrangements, that in order to improve the handiness and in order to make the release of the weights more easy, provide activation elements, such as handles or bands, that activate the weight release.

However, when diving, such elements can be accidentally hit or can be entangled, causing the weights to be unintentionally released and causing them to be consequently lost.

Finally, once the male element is released from the female element, the releasable connection devices known in prior art have objective difficulties if the diver desires to lock again the male element to the female element, due above all to the critical conditions of use thereof, that is in a submarine environment and with a limited visibility of the diver, both due to the poor light and due to the provision of the mask that reduces the field of vision of the diver.

Therefore there is the unsatisfied need in prior art known devices to provide a releasable connection device overcoming the drawbacks described above.

The present invention achieves the above aims by providing a releasable connection device such as described hereinbefore, wherein the relative motion between the activation/deactivation slider and the male element is transmitted to first removable locking members belonging to the male element cooperating with corresponding second locking members belonging to the female element, such to pass from a stable locking condition to a stable release condition of the male element with the female element.

Particularly the passage from the locking condition to the release condition is performed by a translational action exerted on the slider in the direction of removal of the male element from the female element. Such translational action is exerted by means of a pulling action on the slider, or as it will be described below, on a handle element belonging to it, a pulling action whose continuation causes the pouch containing the ballast to be removed from the suitable housing in the jacket.

Thus the release condition is an integral part of the movement removing the pouch containing the ballast. In case of emergency or undressing, the handle is pulled, activating the slider, for removing the ballast.

By pulling the slider in the release condition, the buckle, integral with the male element and connected to the weight pouch, is released such to remove the weight pouch.

Consequently the pouch is easily removed, with no need for the diver to pay particular attention to the several manoeuvres to be made, which is a particularly important aspect in emergency/panic conditions.

Since the release condition occurs only by a pulling action to be performed on the slider, consequently an accidental removal of the weight pouch is excluded, which would cause an uncontrolled ascent of the diver with possible consequences such as embolism or decompression diseases.

On the basis of what described above, preferably the device of the present invention relates to a device for connecting a weight pouch to a pocket of a diver jacket.

In this case the first element will be a weight pouch, while the second element will be at least a part of a diver jacket.

However it is noted that the inventive concept of the present device is not limited to the provision of a weight pouch and it goes well beyond the use in the diving field.

As it will be clear from one embodiment shown below, the device of the present invention for example can be used in the automotive field, as an emergency solution for releasing safety belts after an accident, for example if it is difficult to use the usual release button.

According to one improvement the activation/deactivation slider passes from a maximum backward condition, corresponding to the active release condition, to a maximum forward condition, corresponding to the active locking condition, the activation/deactivation slider being composed of an elongated element, which, at the end faced towards the female element has an enlarged head such that the enlarged head, passing from the maximum backward condition to the maximum forward condition, pushes the first locking members towards the inner walls of the female element, such that the first locking members engage the second locking members placed on the inner walls of the female element.

Unlike prior art known devices, such arrangement allows the locking between the male element and the female element to be mechanically activated, the locking between the two elements, in order to avoid them from sliding with respect to each other, is guaranteed by the fact that the first locking members are pushed and held by the slider towards the second locking members, allowing them to mutually engage.

Therefore an elastic activation is not provided, that is the locking is not guaranteed by a force risen from an elastic deformation which leads to a coupling condition between teeth on the male element and corresponding seats on the female element, and the holding effect is not guaranteed by the mere locking condition between teeth and seats, with the drawbacks deriving therefrom and known in the prior art, such as for example the wearing of the teeth or the loss in elasticity of the material of the device and the consequent malfunction of the holding effect.

The mechanical activation, as it will be disclosed in some embodiments shown below, is guaranteed by the form fit of the first locking members of the male element with the second locking members of the female element.

Moreover the mechanical activation guarantees the lack of clearances, that is the lack of relative undesired movements between the male element and the female element, that on the contrary could be present in the case of an elastic activation.

According to a preferred embodiment, the two first locking members are composed of two peripheral tongues.

The enlarged head has two head edges on each end, intended to cooperate with corresponding head edges of the end portions of the two tongues.

The head edges of the enlarged head have surfaces for the abutment of the head edges of the tongues, such that the two tongues are symmetrically pushed and held in a maximum mutual spreading apart condition during the passage from the maximum backward condition to the maximum forward condition of the slider.

Moreover preferably when the slider is in the maximum backward condition the two tongues are in the maximum mutual approaching condition.

As it will be clear from some annexed embodiments, the maximum mutual approaching condition can be obtained by different arrangements.

For example it is possible to provide the two peripheral tongues to be rigid and to be hinged at the base such to pivot in the absence of the action exerted by the abutment surfaces of the enlarged head, which forces them in the maximum spreading apart condition.

It is further possible to provide members both on the enlarged head and on the tongues, intended to force the peripheral tongues to follow the movement of the slider in the passage from the maximum backward condition to the maximum approaching condition and vice versa.

As an alternative it is possible to obtain the maximum approaching condition between the tongues due to the intrinsic elasticity of the material of the tongues, that in the absence of forces acting thereon tends to cause the tongues to return in the original condition, that is in the maximum mutual approaching condition corresponding to the locking condition.

According to a variant embodiment of the arrangement just described, the two tongues on the outside have a leading tapered end portion, preferably curved.

Moreover the enlarged head of the slider has, on the outside in the direction of the female element, a curved surface, connecting to the two end portions of the tongues in the maximum forward condition of the slider, such to be a harmonious continuation surface thereof.

According to a preferred embodiment, the activation/deactivation slider is provided at the longitudinal axis of the male element.

According to such arrangement the first locking members are positioned at the sides of the slider and each one has a first engagement tooth coupling in a second corresponding engagement tooth provided on the inner walls of the female element.

It is noted that the embodiments mentioned below are directed to improvements carried out on the implementations of the components of the device of the present invention, above all directed at improving the main aspects of the similar devices known in the prior art.

As it will be appreciated in the following description and figures, the several variant embodiments improve the stability of the locking and release conditions, the facility of inserting the male element in the female element, optimizing the handiness of the whole device.

According to a first improvement each one of the two first locking members is composed of one rigid element. The two rigid elements are in a stable maximum mutual approaching condition when the activation/deactivation slider is in the maximum backward condition, while the two rigid elements are in the maximum mutual spreading apart condition when the activation/deactivation slider is in the maximum forward condition.

In practice, the activation is caused by the buckle being inserted during the dressing action while the deactivation is caused by the pulling action on the handle that then causes the pouch to be removed from its housing in the jacket.

The peripheral positioning of the two rigid elements at the sides of the slider allows the slider to symmetrically push the rigid elements, such to obtain a contemporaneous coupling of the engagement teeth of the male element and of the female element.

According to a first embodiment the rigid elements are composed of an elastically deformable material.

The fact of making the rigid elements of an elastically deformable material, even with the male element not inserted in the female element, allows the slider to be brought in the maximum forward condition, that in turn pushes the rigid elements in the locking condition, and then the male element is inserted in the female element.

Such aspect is particularly advantageous since under critical situations it is always possible to insert the male element in the female element, regardless of the positioning of the slider.

As an alternative or in combination it is possible to provide the two rigid elements to be also hinged at the base, that is to be free to move without being subjected to any deformations: the passage from the engagement to disengagement is generated by the axial forward-backward movement of the slider that, in the maximum forward condition, pushes the two rigid elements outwardly, while in the maximum backward condition pulls the two rigid elements inwardly.

According to a preferred embodiment, the two first locking members are composed of two peripheral tongues, that on the outside have a leading tapered end portion, preferably curved, each tongue having, at a specific distance from the end portion, the first engagement tooth composed of a notch of the tongue, which is placed at the connecting area of the substantially longitudinal straight portion of the tongue.

The enlarged head of the slider on the outside towards the female element has a curved surface which is connected to the two end portions of the tongues in the maximum forward condition of the slider such to be a harmonious continuation surface thereof.

Moreover the enlarged head has two head edges on each end, intended to cooperate with corresponding end head edges of the end portions of the two tongues: the head edges of the enlarged head therefore form surfaces for the abutment of the head edges of the tongues such that the two tongues are symmetrically pushed and held in the maximum mutual spreading apart condition during the passage from the maximum backward condition to the maximum forward condition of the slider.

The surface formed by the enlarged head and by the tongues allows the male element to be inserted in the female element in a further facilitated manner, it is a leading, curved, continuous surface that do not necessarily require the male element and the female element to be aligned along the longitudinal axis, but it allows them to be inserted one inside the other one even in the non-aligned condition.

According to a possible embodiment, that will be clearly shown in the figures annexed in the present document, the enlarged head has two extensions inclined with respect to the axis of insertion, which are guide flaps cooperating with abutment flaps.

Each tongue has an abutment flap extending, with a specific inclination towards the guide flaps.

The guide flaps and the abutment flaps cooperate in such a manner to guarantee the movement of the tongues in the desired manner, that is it allows them to spread apart upon insertion and to approach upon removal, thus guaranteeing the engagement or disengagement of the locking.

The different embodiments of the device of the present invention aim also at achieving the advantageous aspects described above, optimizing the use of the material and facilitating the assembly of the several parts of the device, in order to obtain advantages regarding the production, which is made more efficient and less expensive as regards the economic point of view.

Preferably the male element is composed of a first bottom part comprising at least the two peripheral tongues and a central housing channel for slidably housing the slider, the male element comprising a second cover part, coupling to the first bottom part, such to allow the activation/deactivation slider to slidably engage.

Moreover the slider is composed of an elongated element at whose end opposite to the enlarged head there being provided an element of the handle type or the like, such to facilitate the activation of the sliding of the slider itself.

Finally the first bottom part is made as one piece and it is composed of a frame composed of a rear wall, five uprights extending from such wall, two of which are peripheral uprights, two are internal uprights and a central upright.

The peripheral uprights are the two tongues, while the central upright is a guide element for the sliding of the slider in the housing channel. The internal uprights on the contrary act for hooking the second cover part.

Particularly the internal uprights can have hooking seats for corresponding hooking teeth belonging to the second cover part.

According to a further embodiment the female element has at least one cutout intended to show the maximum backward condition or the maximum forward condition of the slider.

For example it is possible to insert marks identifying the condition of the slider, such that in the maximum backward condition the mark identifying the maximum backward condition matches with the cutout, while in the maximum forward condition the cutout displays the corresponding mark, allowing a confirmation of the engagement activation to be obtained, a very important feedback before starting the immersion.

These and other characteristics and advantages of the present invention will be more clear from the following description of some embodiments shown in the annexed drawings wherein:

FIG. 1 is a perspective view of the device for releasably connecting a weight pouch to a pocket of a scuba diving jacket of the present invention;

FIGS. 2*a* and 2*b* are two sections of the device of the present invention with the male element inserted in the female element, in the release and locking condition respectively;

FIGS. 3*a* and 3*b* are the male element of the present invention with the slider in the maximum backward condition and in the maximum forward condition respectively;

FIGS. 4*a* and 4*b* are two sections with respect to the transverse plane and the longitudinal plane of a perspective view of the male element of the device of the present invention;

Figure 7B:
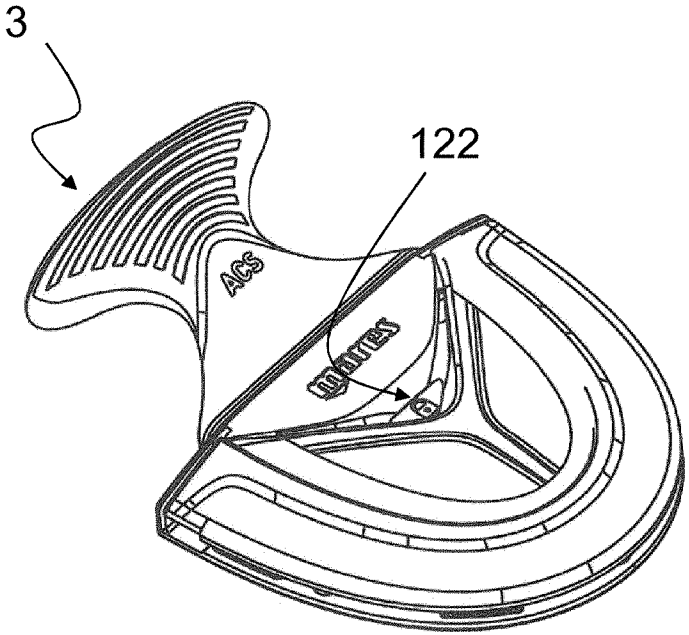
Figure 7A:
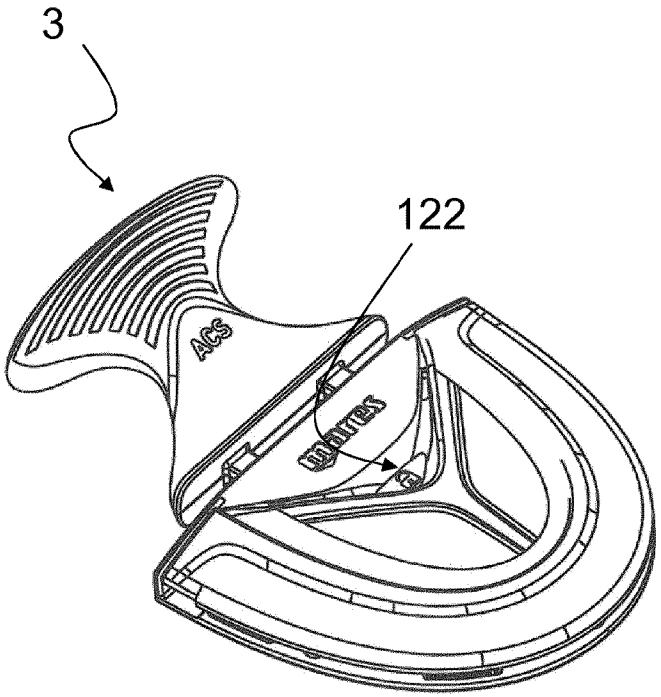
Figure 8A:
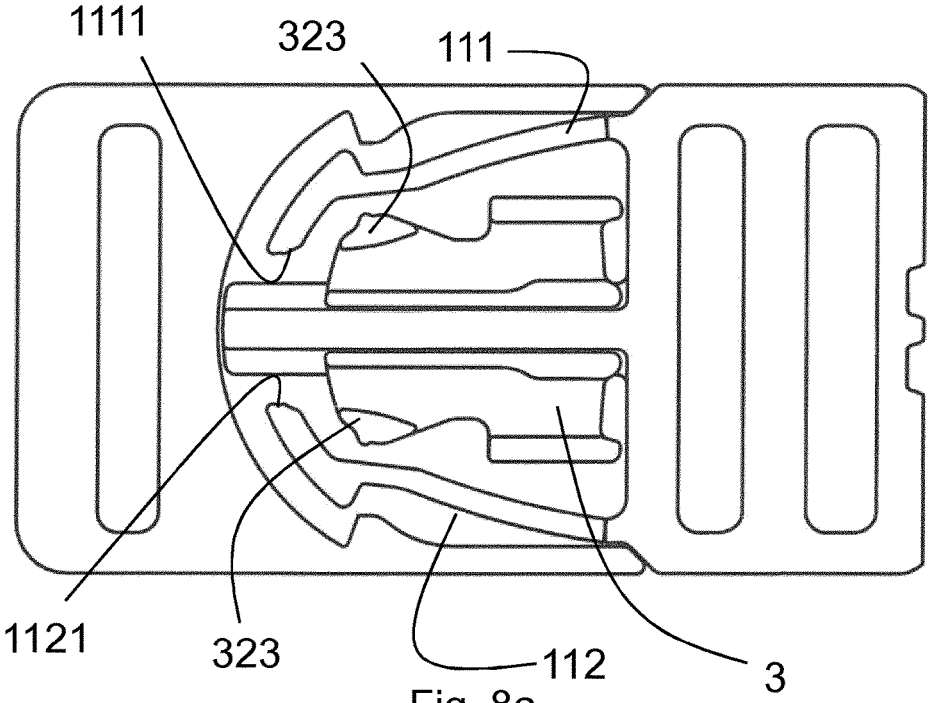
Figure 8B:
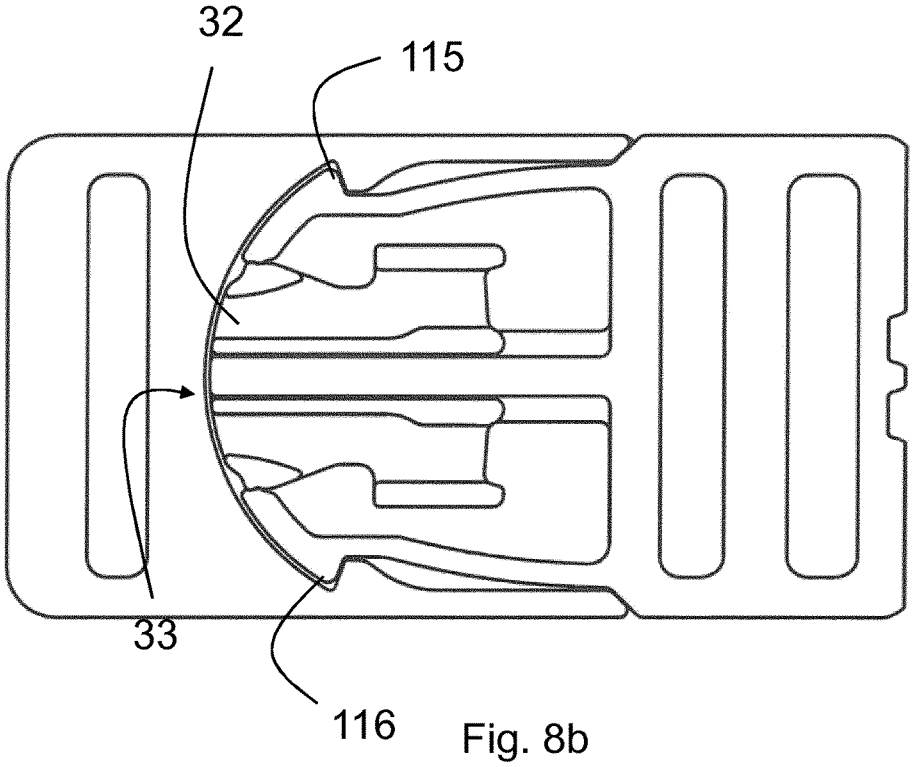
Figure 9A:
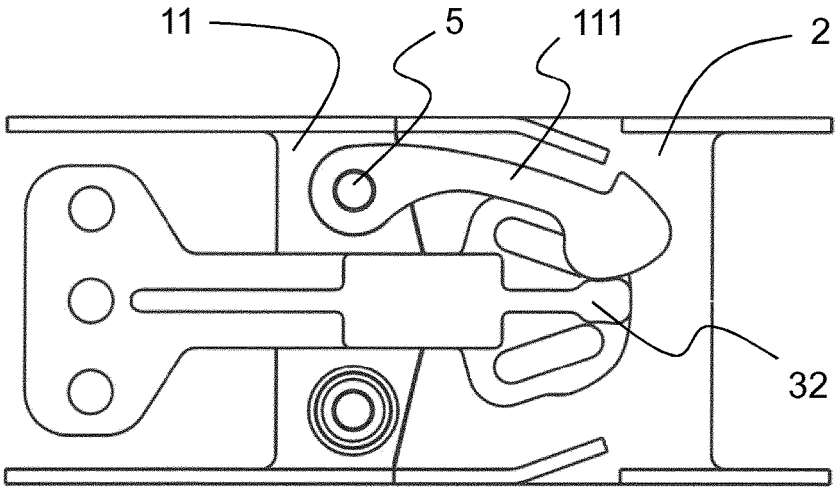
Figure 9B:
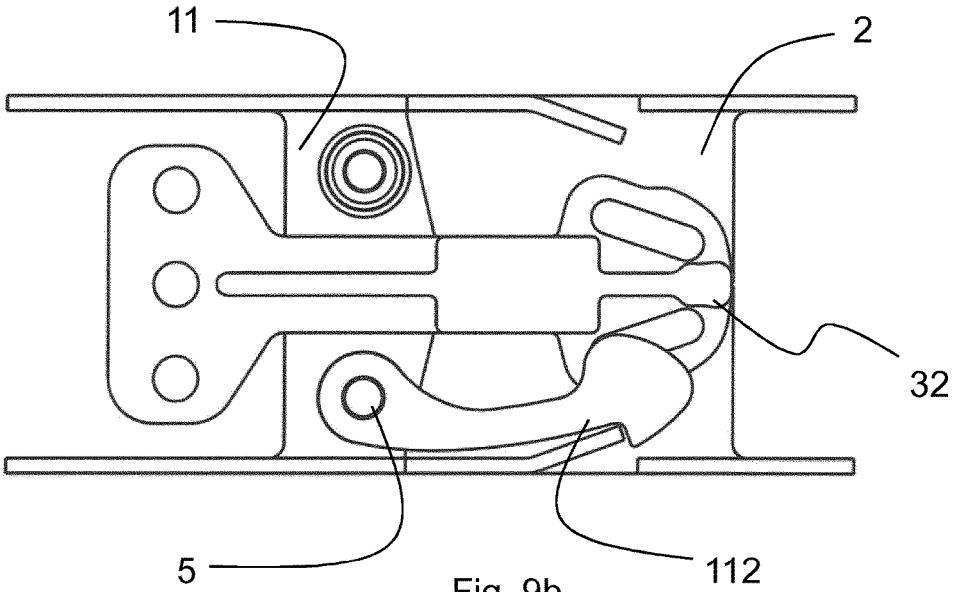
Figure 9C:
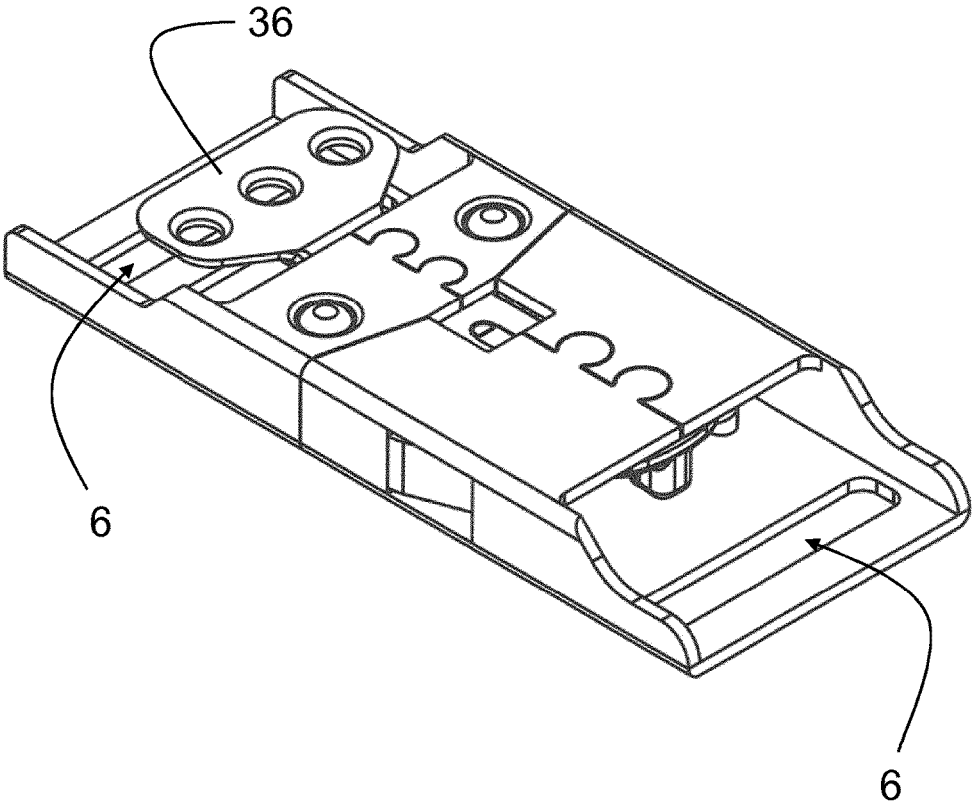

FIGS. 7*a* and 7*b* are a top view of the device of the present invention, in the release and locking condition respectively;

FIGS. 8*a* and 8*b* are two sections of the device of the present invention with the male element inserted in the female element, in the release and locking condition respectively;

FIGS. 9*a*-9*c* are a further variant embodiment of the device of the present invention.

It is noted that the variant embodiment shown in the annexed figures is shown only for illustrative purposes and for better explaining the concepts and advantages of the device of the present invention, but it has not to be considered as a limitation of the inventive concept of the present patent application, which is to provide a device for releasably connecting a weight pouch to a pocket of a scuba diving jacket having a male element easily insertable and/or removable from the female element, further having an active locking condition and an active release condition.

Figure 1:
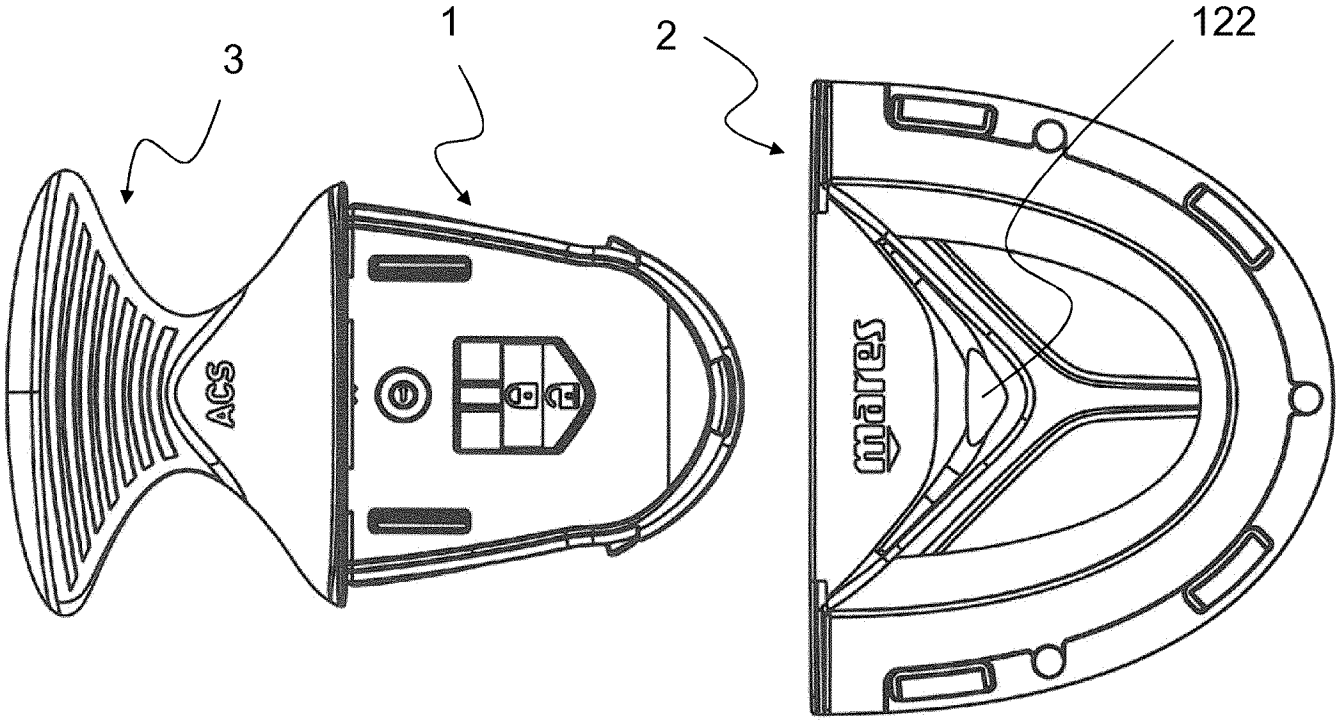

With particular reference to FIG. 1, the device for releasably connecting a weight pouch to a pocket of a scuba diving jacket of the present invention comprises a male element 1 connectable by means of a band to a weight pouch.

The male element 1 is inserted into a female element 2, such that the male element 1 and the female element 2 pass from a disengagement condition to a mutual engagement condition.

There is further provided a slider 3 activating/deactivating the engagement condition, which is engaged with the male element 1 in a manner slidable along the axis of insertion of the male element 1 into the female element 2.

The relative movement between the activation/deactivation slider 3 and the male element 1 is transmitted to first removable locking members, belonging to the male element 1, that cooperate with corresponding second locking members belonging to the female element 2, such to pass from a stable locking condition to a stable release condition of the male element 1 with the female element 2.

The passage from the locking condition to the release condition is carried out by a translation exerted on the slider 3 in the removal direction.

Figures 2A, 2B:
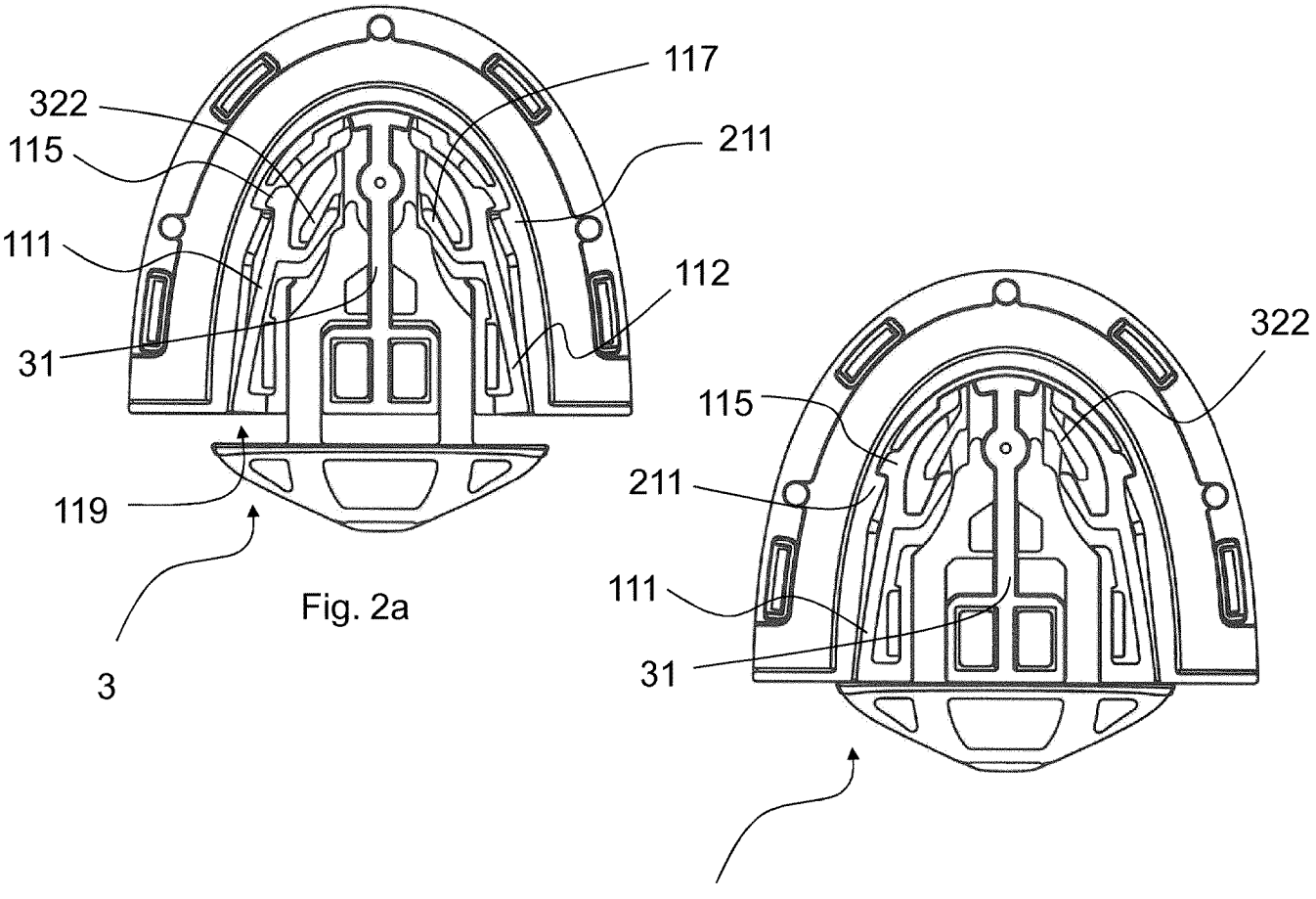

FIGS. 2*a* and 2*b* show the two active locking and release conditions of the male element 1 with the female element 2.

As it is clear from the figures the slider 3 passes from a maximum backward condition, FIG. 2*a*, corresponding to the active release condition, to a maximum forward condition, FIG. 2*b*, corresponding to the active locking condition.

The slider 3 is composed of an elongated element 31, which, at the end faced towards the female element 2, has an enlarged head 32, such that the enlarged head 32, passing from the maximum backward condition to the maximum forward condition, pushes the first locking members towards the inner walls of the female element 2, such that the first locking members 115 engage the second locking members placed on the inner walls of the female element 2.

As it is clear from FIGS. 2*a* to 3*b* the device of the present invention is made in such a manner that the slider has two end-of-travel positions along its travel, one related to the maximum backward condition and one related to the maximum forward condition.

With a particular reference to the figures mentioned above, the slider 3 is provided at the longitudinal axis of the male element 1, while the first locking members are positioned at the sides of the slider 3 and each one has a first engagement tooth 115 coupling into a corresponding second engagement tooth 211 provided on the inner walls of the female element 2.

Figure 3B:
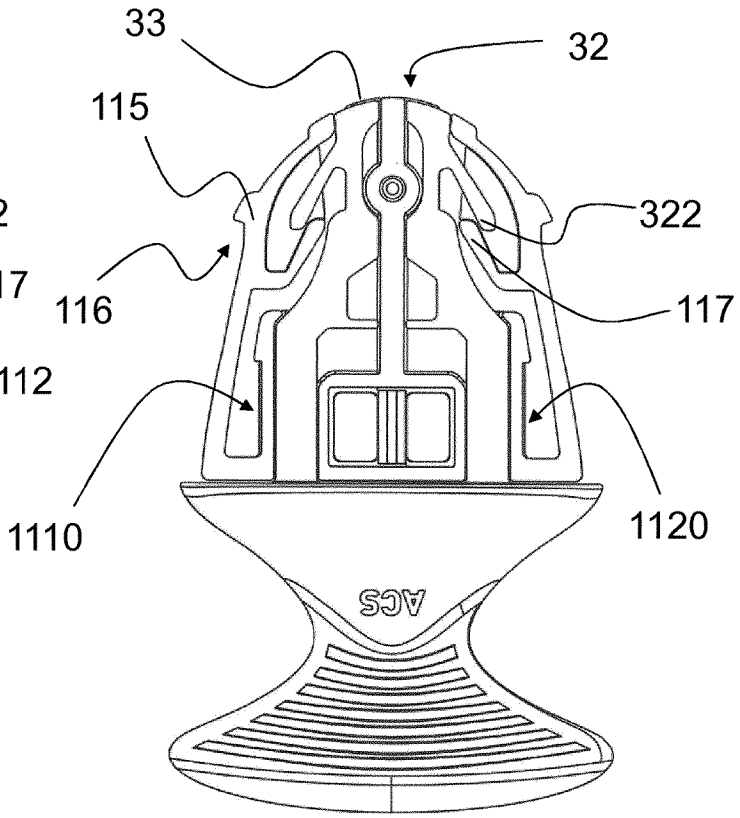
Figure 3A:
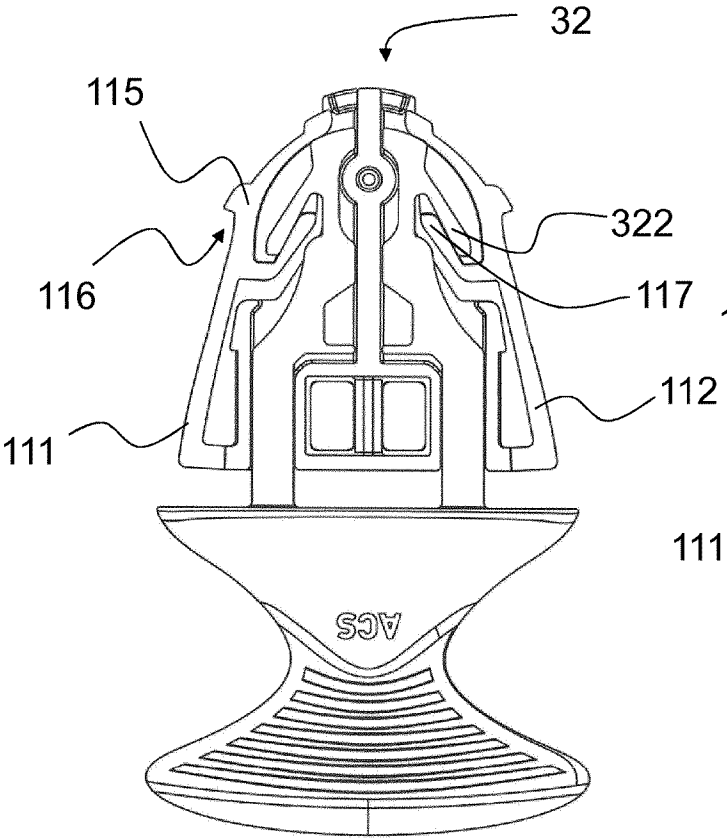

Particularly each one of the two first locking members is composed of a rigid element made of an elastically deformable material and such rigid elements 111 and 112 are in a stable maximum mutual approaching condition, FIG. 3*a*, when the slider 3 is in the maximum backward condition, while the two rigid elements 111 and 112 are in the maximum mutual spreading apart condition when the slider 3 is in the maximum forward condition.

Depending on the arrangement, the two rigid elements 111 and 112 can be elastically deformed in the maximum spreading apart condition or in the maximum approaching condition, or in both the conditions.

In the case where the two rigid elements 111 and 112 are elastically deformed in the spreading apart condition, that is in the maximum forward condition of the slider 3, they are elastically loaded and the return to the approaching condition takes place automatically due to intrinsic elasticity issues of the material, when the slider 3 starts the backward travel.

Similarly it occurs when the two rigid elements 111 and 112 are elastically deformed in the approaching condition.

According to a possible embodiment the two rigid elements 111 and 112 can also be hinged at the base, that it they can be free to move without being subjected to any deformations: the passage from engagement to disengagement is generated by the axial forward-backward movement of the slider 3, that, in the maximum forward condition, pushes the two rigid elements 111 and 112 outwardly, while in the maximum backward condition, it pulls the two rigid elements 111 and 122 inwardly.

As it will be described below, according to a preferred variant embodiment of the device of the present invention, the movement of the rigid elements 111 and 112, particularly the inward movement corresponding to the maximum approaching condition thereof, is obtained by the provision of guide flaps 322 cooperating with abutment flaps 117.

With a particular reference to FIGS. 3*a* and 3*b*, the first two locking members are composed of two peripheral tongues 111, 112, which, on the outside, have a leading tapered end portion, preferably curved.

With a particular reference to the shown variant embodiment, the end portion of each tongue 111 and 112 comprises the first engagement tooth 115.

Particularly each tongue 111 and 112 has, at a specific distance from the end portion, the first engagement tooth 115 composed of a notch 116 of the tongue 111 and 112, which is placed at the connecting area of the substantially longitudinal straight portion of the tongue.

The enlarged head 32 of the slider 3 on the outside towards the female element 2 has a curved surface 33 which is connected to the two end portions of the tongues 111 and 112 in the maximum forward condition of the slider 3, FIG. 3*b*, such to be an harmonious continuation surface thereof.

Particularly the curved surface 33 has an arcuate portion with a length corresponding to the portion of maximum distance of the two tongues 111 and 112, in the maximum forward condition of the slider 3.

Figure 4A:
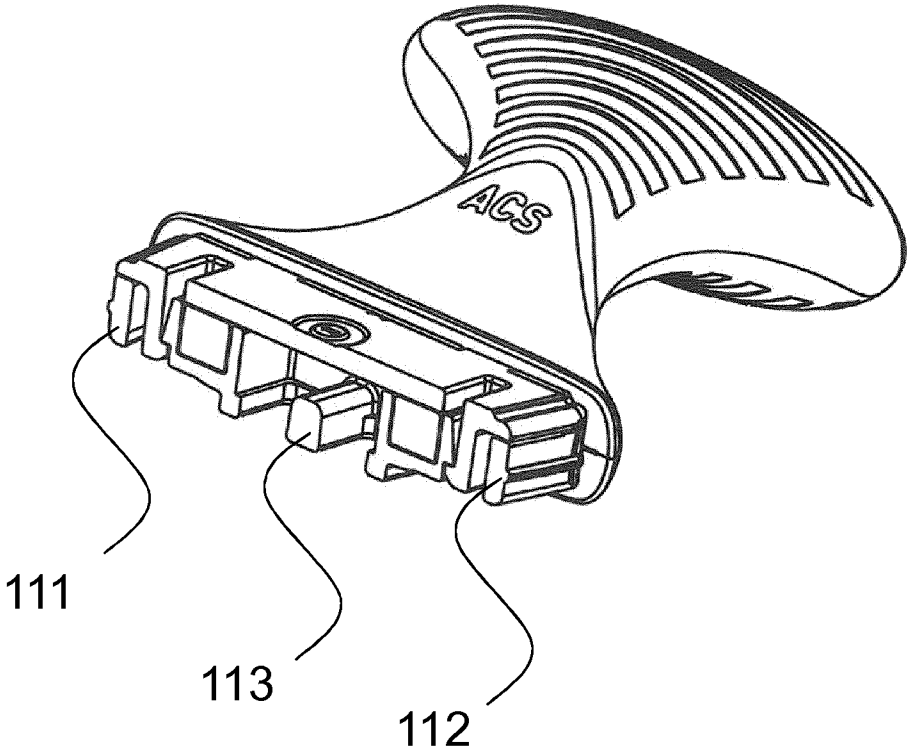
Figure 4B:
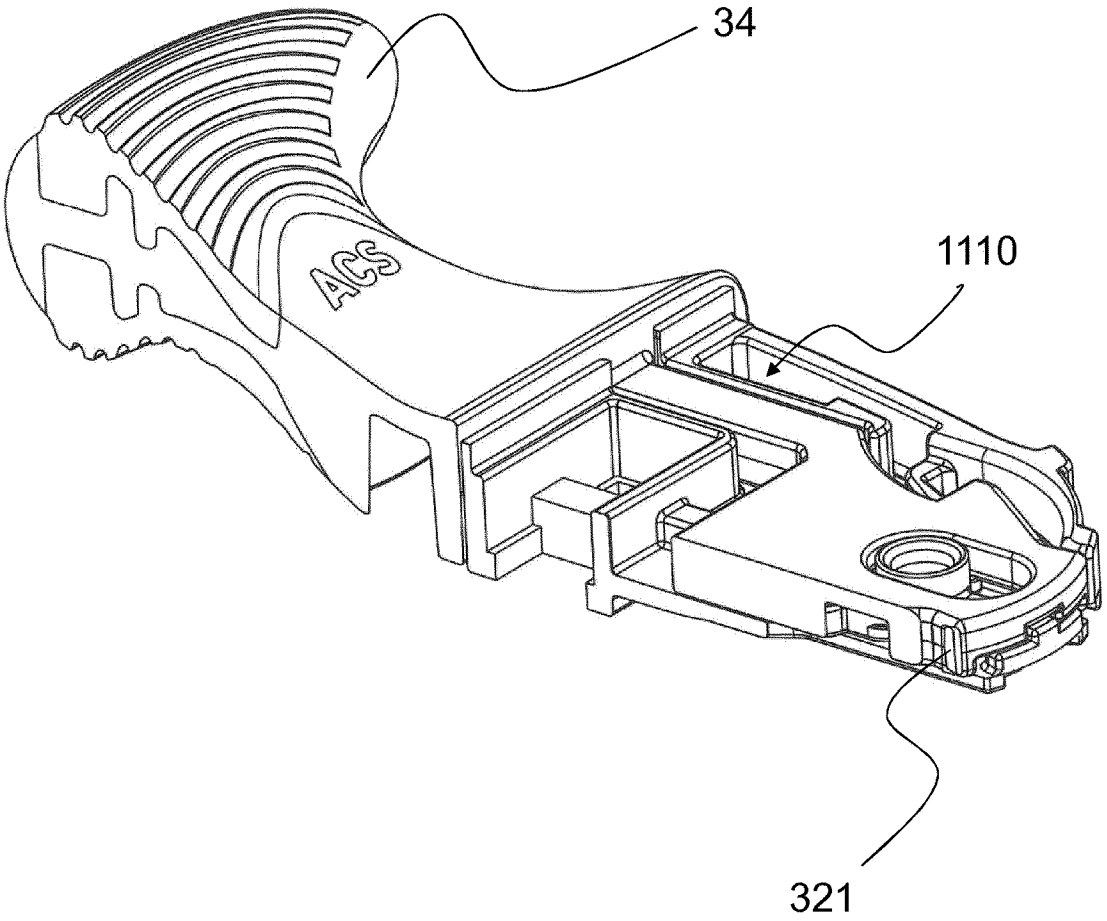

Moreover the enlarged head 32 has two head edges 321, shown in FIG. 4*b*, on each end, intended to cooperate with corresponding end head edges of the end portions of the two tongues 111 and 112.

The head edges 321 of the enlarged head 32 therefore have surfaces for the abutment of the head edges of the tongues 111, 112, such that the two tongues 111, 112 are symmetrically pushed and held in the maximum mutual spreading apart condition during the passage from the maximum backward condition to the maximum forward condition of the slider 3.

With a particular reference to FIGS. 3*a* and 3*b*, the enlarged head 32 has two extensions 322 belonging to the elongated element 31 positioned rearwardly of the curved surface 33 and of the enlarged head 32.

Such extensions 322 extend with an inclination with respect to the axis of insertion and they form two guide flaps 322 cooperating with the abutment flaps 117.

Each tongue 111 and 112 has an abutment flap 117 extending with a specific inclination towards the guide flaps 322, and that cooperates with the guide flaps 322, in such a manner to guarantee the movement of the tongues in the desired manner, that is it allows them to spread apart upon insertion and to approach upon removal, thus guaranteeing the engagement or disengagement of the locking upon the pushing or pulling action by the slider 3.

The provision of the abutment flaps 117 and of the guide flaps 322, together with the provision of the abutment surfaces of the head edges of the enlarged head 32 and of the tongues 111 and 112, allows two mutual snap actions to be obtained in the maximum forward and backward conditions of the slider 3.

Advantageously the guide flaps 322 and abutment flaps 117 are stabilization guides that exert opposite actions during the travel of the slider 3.

Particularly, as it is clear from FIGS. 3*a* and 3*b*, in the maximum backward condition of the slider 3, the tongues 111 and 112 are firmly held in the mutual approaching condition by means of the contact of the flaps 322 and 117, similarly in the maximum forward condition of the slider 3, the tongues 111 and 112 are firmly held in the mutual spreading apart condition by the contact of the head edge 321 with the end of the engagement tooth 115 and by the contact between the flaps 322 and 117.

From the maximum backward condition, FIG. 3*a*, to the maximum forward condition, FIG. 3*b*, the guide flaps 321 slide on the upper surface of the abutment flaps 117.

Therefore the contact of the flaps 321 and 117 is kept in the maximum backward condition up to the maximum forward condition.

The movement of the rigid elements 111 and 112 from the maximum mutual approaching condition to the maximum mutual spreading apart condition, leads to a negligible elastic tensile condition.

The movement of the rigid elements 111 and 112 that generates the engagement of the engagement tooth 115 with the inner walls of the female element 2 is due to the movement of the slider 3, that, in the maximum forward condition, pushes the rigid elements 111 and 112 outwardly with respect to the elongated element 31.

Similarly in the maximum backward condition, the slider 3 pulls towards itself the elongated elements 111 and 112 in the maximum mutual approaching condition.

The contact of the flaps 117 and 322 during the travel of the slider 3 allows the two rigid elements 111 and 112 to obtain both a stable maximum approaching condition and a stable maximum spreading apart condition.

FIGS. 4*a* to 6 show a variant embodiment of the device of the present invention showing the particular arrangement of the components of the device, particularly it shows how they are divided and assembled together.

Particularly the female element 2 is composed of a sheath element allowing the male element 1 to be inserted therein, the second engagement tooth 211 being provided on the inner walls of said sheath element.

Figure 5:
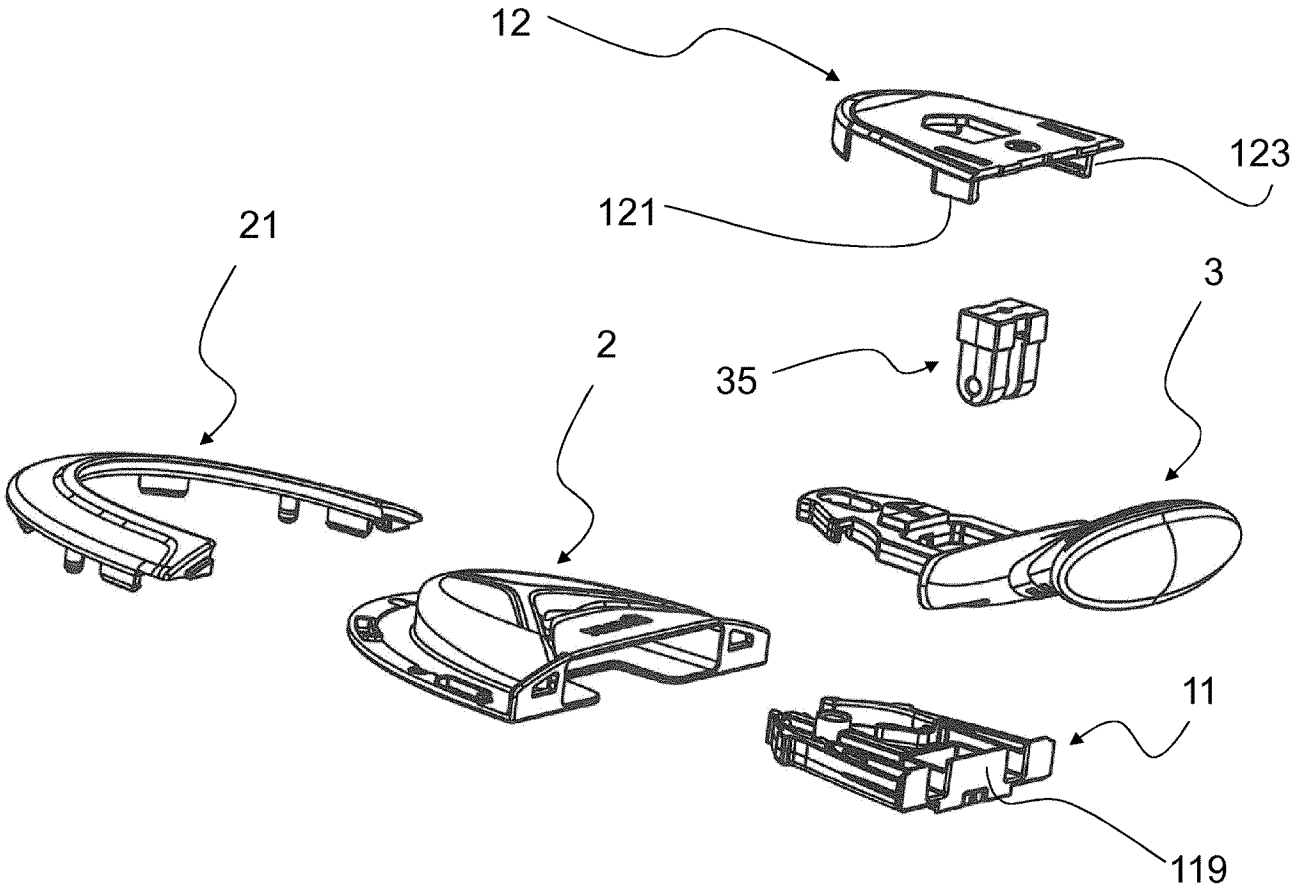
FIG. 5 is an exploded view of the device of the present invention.

According to the variant embodiment shown in FIG. 5, the female element 2 has means 21 fastening the female element 2 to the diver's jacket 4.

The male element 1 is composed of a first bottom part 11 comprising the two peripheral tongues 111 and 112 and a central housing channel for slidably housing the slider 3.

Moreover the male element 1 comprises a second cover part 12, coupling to the first bottom part 11 such to allow the slider 3 to slidably engage.

The slider 3 is composed of an elongated element 31 at whose end opposite to the enlarged head 32 there being provided an element of the handle type 34 or the like.

The slider is preferably made as one piece and of plastic material.

The male element 1 preferably is connected to the weight pouch by means of a connection element 35 in any manner known in the prior art.

Figure 6:
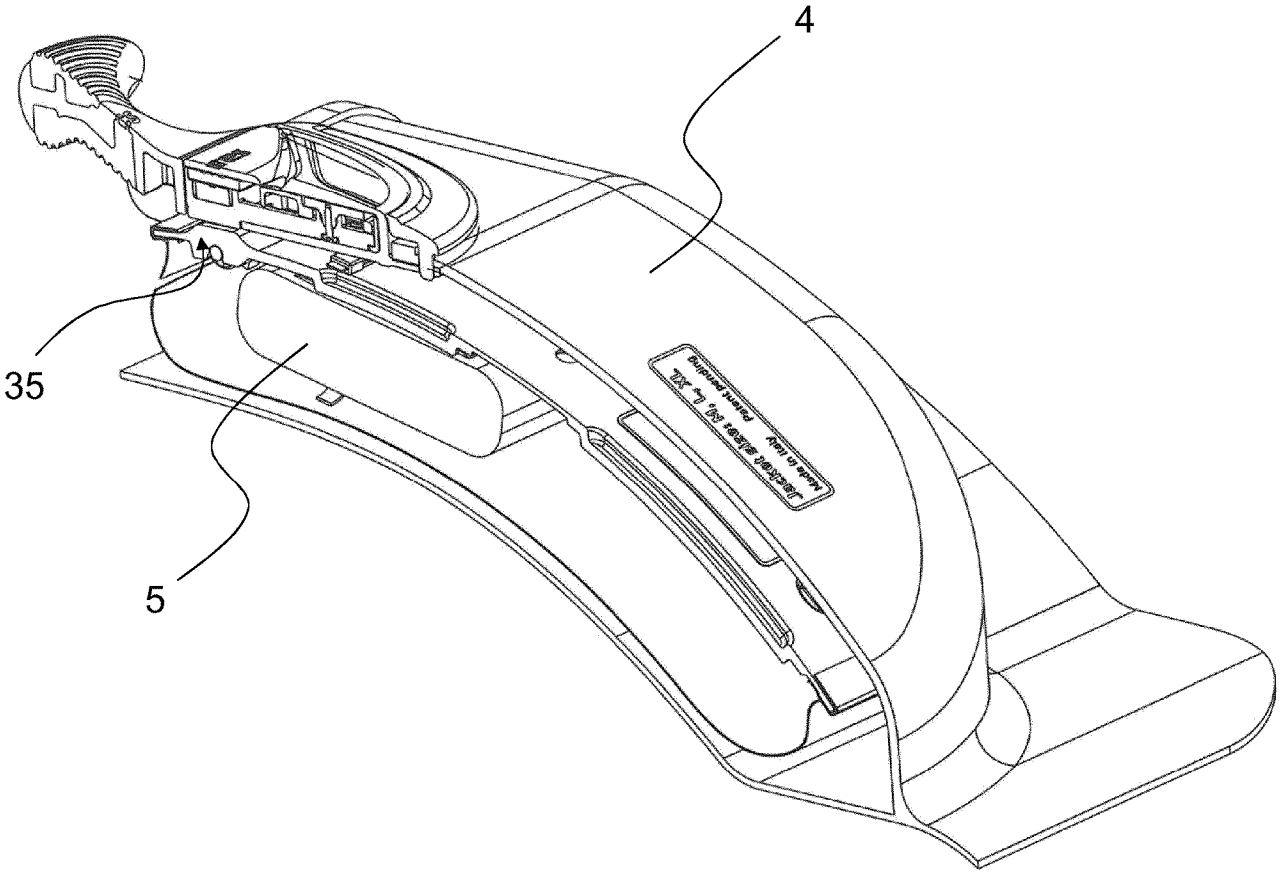
FIG. 6 is a side section of the device of the present invention connected to a weight pouch.

FIG. 6 particularly shows the use of the releasable connection device of the present invention connected to a weight pouch 5.

The shape of the connection element 35 is such to allow an element made of polyurethane to be used, which has one end cooperating with the connection element 35 and the other end cooperating with the weight pouch.

As an alternative it is possible to provide to use a tape or the like.

With a particular reference to FIGS. 3*a* to 6, the first bottom part 11 is made as one piece and it is composed of a frame having a rear wall 119, five uprights extending from such wall, two of which are peripheral uprights 111 and 112, two are internal uprights 1110, 1120 and a central channel 113.

According to such variant the peripheral uprights 111 and 112 are the tongues described above, while the central upright 113 is a guide element for facilitating the slider 3 to properly slide.

Advantageously the internal uprights 1110 and 1120 have hooking seats, for corresponding hooking teeth 121, 123 belonging to the second cover part 12, that guarantee the bottom part 11 and the cover part 12 to be assembled and locked.

It is possible to provide further locking elements, such as screws, pins or the like, that fasten together the components of the device of the present invention.

Such pins, screws or the like can provide engagement seats obtained in the thickness of the body of the male element 1.

Finally according to the variant embodiment shown in FIGS. 7*a* and 7*b* it is possible to provide a cutout 122, on the female element 2, that shows the locking or release condition of the device of the present invention.

Particularly on the slider 3 it is possible to provide marks identifying the release condition or the locking condition.

On the basis of the position of the slider 3 the cutout 122 of the female element 2 coincides with a different mark: in FIG. 7*a* the slider 3 is in the maximum backward position and the cutout 122 shows the release condition, while in FIG. 7*b* the slider 3 is in the maximum forward condition and the cutout 122 shows the locking condition.

FIGS. 8*a* and 8*b* show a variant embodiment of the device of the present invention, particularly a section of the device of the present invention in the release and locking conditions respectively.

Particularly the figures show one embodiment wherein the guide flaps 132 and the abutment flaps 117 of the previous figures are not provided.

Even in this case the first two locking members are composed of two tongues 111 and 112.

The enlarged head 32 has two head edges on each end, intended to cooperate with corresponding end head edges of the end portions of the two tongues 111, 112.

As in FIGS. 2*a* and 2*b*, the head edges of the enlarged head 32 are abutment surfaces 323 for the head edges 1111 and 1121 of the tongues 111 and 112, such that the two tongues 111 and 112 are symmetrically pushed and held in the maximum mutual spreading apart condition, such as shown in FIG. 8*b*, during the passage from the maximum backward condition to the maximum forward condition of the slider 3.

In the maximum mutual spreading apart condition the tongues 111 and 112, teeth 115 and 116 are in the condition engaging the corresponding engagement seats provided on the female element 2, such to obtain the locking condition.

Once the slider 3 returns back in the maximum backward condition, FIG. 8*a*, the tongues 111 and 112 tend to return in the maximum mutual approaching condition.

As anticipated, the maximum mutual approaching condition can be obtained in a different manner and according to different embodiments.

With particular reference to FIGS. 8*a* and 8*b*, the maximum approaching condition between the tongues 111 and 112 is obtained by the intrinsic elasticity thereof.

On the contrary a possible alternative is to provide the slider 3, particularly the enlarged head 32, to pull back the tongues 111 and 112 when the slider 3 moves from the maximum forward condition to the maximum backward condition.

An arrangement of such possible alternative for example is the one shown in the previous figures wherein the action of the guide flaps 132 with the abutment flaps 117 allow the slider 3 to pull the tongues 111 and 112 in the maximum approaching condition.

Generally, since it does not depend on the intrinsic elasticity of the tongues 111 and 112, it is possible to provide members on the enlarged head 32 that move the tongues 111 and 112 during the passage of the slider 3 from the maximum forward condition to the maximum backward condition and vice versa, that is members carrying out an action similar to that of the guide flaps 132 and the abutment flaps 117.

A possible implementation will be described below with reference to FIGS. 9*a*, 9*b* and 9*c*.

According to a possible embodiment the abutment surfaces 232 and the end surfaces 1111 and 1121 can have such a shape that, starting from a locking condition, the removal of the male element 1 from the female element 2 causes the tongues 111 and 112 to be compressed and causes the slider 3 to move from a maximum forward condition to a maximum backward condition.

Moreover according to a further variant embodiment, shown in FIG. 8*b*, the two tongues 111 and 112 on the outside have a leading tapered end portion, preferably curved.

The enlarged head of the slider 3 on the outside towards the female element 2, has a curved surface 33, which curved surface 33 is connected to the two end portions of the tongues 111, 112 in the maximum forward condition of the slider 3, such to be an harmonious continuation surface thereof.

FIGS. 9*a*, 9*b* and 9*c* show a further variant embodiment of the device of the present invention.

Tongues 111 and 112 are hinged at the bottom part 11 by means of hinges 5.

With a particular reference to FIGS. 9*a* and 9*b*, the tongues 111 and 112 are provided at the two different sides of the bottom part 11, but they can be obviously provided also at the same side.

In the case the tongues 111 and 112 are provided at the two opposite sides of the bottom part 11 it is possible to provide to use two different sliders 3, that is a slider 3 for each tongue 111 and 112 responsible for the movement thereof.

Particularly in FIG. 9*a*, the slider 3 is in the maximum backward condition, the tongues 111 and 112 are in the maximum approaching condition and the male element is released with respect to the female element.

In FIG. 9*b* the slider 3 is in the maximum forward condition, the tongues 111 and 112 are in the maximum spreading apart condition and the male element 1 is attached to the female element 2, by the action of the teeth 115 and 116 that are in the condition engaged with the corresponding engagement seats provided on the female element 2.

The shape of the enlarged head 32 and of the end portion of the tongues 111 and 112 can be such to allow the enlarged head 32 to push the tongues 111 and 112 in the maximum mutual spreading apart condition during the forward movement of the slider 3 and such to allow the enlarged head 32 to pull back the tongues 111 and 112 during the backward movement of the slider 3.

Such movement for example can be obtained by the interaction of the contact surfaces of the enlarged head 32 and of the tongues 111 and 112, as well as by the hinges 5 that allow the tongues 111 and 112 to pivot.

As an alternative it is possible to provide the enlarged head 32 only to push the tongues 111 and 112 in the maximum mutual spreading apart condition, but once the slider 3 is in the maximum backward condition, and to provide such tongues to be free to pivot due to the provision of the hinges 5 and therefore the male element can be removed from the female element 2.

According to a further embodiment it is possible to provide elastic elements, of the spring type, inside the hinges 5 that urge the tongues 111 and 112 to remain in the mutual approaching condition.

Particularly as said above such variant embodiment aims at providing a device that has all the mentioned characteristics, as an alternative or in combination, and that is usable in the automotive field, as an emergency solution for releasing the safety belts after an accident, for example in the case when it could be difficult to use the usual release button.

Such variant is clearly shown in FIG. 9*c*, the borders of the safety belt can be sewn passing through the slots 6 related to the male element 1 and to the female element 2.

Thus the male element 1 is fastened to the female element 2, and in case of emergency, by operating the slider or sliders 3, the tongues are moved and the male element 1 is released from the female element 2.

Therefore it is sufficient to operate the eyelet 36 provided at the end opposite to the enlarged head 32 and connected to the slider 3, for example by inserting one finger and pulling, such to release the male element 1 from the female element 2.

The invention claimed is:

1. Device for releasably connecting a first element to a second element, the first and the second elements being alternately connectable and disconnectable, comprising:

a male element (1) connectable to one end of said first element, such that when said male element (1) is inserted into a female element (2) connectable to one end of said second element, said male element (1) and said female element (2) pass from a disengagement condition to a mutual engagement condition; and a slider (3) activating/deactivating said engagement condition, said slider (3) being engaged to said male element (1) to slide along a direction of insertion of said male element (2) inside said female element (2), wherein a relative motion between said slider (3) and said male element (1) is transmitted to first removable locking members, belonging to said male element (1) and cooperating with corresponding second locking members belonging to said female element (2), such to pass from a stable locking condition to a stable release condition of said male element (1) with said female element (2), wherein passage from the locking condition to the release condition is performed by an action moving said slider (3) in said direction of insertion, wherein said slider (3) passes from a maximum backward condition, corresponding to the release condition, to a maximum forward condition, corresponding to the locking condition, said slider comprising an elongated element (31), at an end faced towards said female element (2), has an enlarged head (32), such that said enlarged head (32), passing from a maximum backward condition to a maximum forward condition, pushes said first locking members towards inner walls of said female element (2), such that said first locking members engage the second locking members placed on the inner walls of said female element (2), wherein the two first locking members comprise two peripheral tongues (111, 112), wherein said enlarged head (32) has two head edges on each end, configured to cooperate with corresponding end head edges of end portions of said two tongues (111, 112), said head edges of said enlarged head (32) being surfaces for abutment of said head edges of said tongues (111, 112), such that said two tongues (111, 112) are symmetrically pushed and held in maximum mutual spreading apart condition during passage from the maximum backward condition to the maximum forward condition of said slider (3), wherein said slider (3) is provided at a longitudinal axis of said male element (1), said first locking members being positioned at sides of said slider (3) and each having a first engagement tooth (115) coupling into a corresponding second engagement tooth (211) provided on inner walls of said female element (2), wherein the two first locking members comprise two peripheral tongues (111, 112), which (111, 112) on an outside have a leading tapered end portion, wherein each tongue (111, 112) has, at a specific distance from said end portion, said first engagement tooth (115) comprising a notch (116) of said tongue, said notch (116) being placed at a connecting area of a substantially longitudinal straight portion of said tongue, wherein said enlarged head (32) of the slider (3) has, on the outside towards said female element (2), a curved surface (33), which is connected to the two end portions of said tongues (111, 112) in the maximum forward condition of said slider (3), such to provide a harmonious continuation surface thereof, wherein said enlarged head (32) has two extensions inclined with respect to the direction of insertion, said extensions being guide flaps (322) cooperating with abutment flaps (117), wherein each tongue has an abutment flap (117) extending with a specific inclination towards said guide flaps (322), and wherein said guide flaps (322) and said abutment flaps (117) cooperate to provide a mutual spreading apart of said flaps with said slider in the forward condition and an approaching of said flaps with said slider in the backward condition, therefore guaranteeing a locking engagement or disengagement upon a pushing or pulling action by said slider (3).

2. Device according to claim 1, wherein said first element comprises a weight pouch, and wherein the second element comprises at least a part of a scuba diving jacket, the device connecting a weight pouch to a pocket of a scuba diving jacket.

3. Device according to claim 1, wherein said two tongues (111, 112) on an outside have a leading tapered end portion, and wherein said enlarged head (32) has, on an outside in the direction of said female element (2), a curved surface (33), which is connected to the two end portions of said two tongues (111, 112) in the maximum forward condition of said slider (3), thereby providing a harmonious continuation surface thereof.

4. Device according to claim 1, wherein each of said two first locking members comprises a rigid element, said rigid elements (111, 112) being in a stable maximum mutual approaching condition when said slider (3) is in the maximum backward condition, and in a maximum mutual spreading apart condition when said slider (3) is in the maximum forward condition.

5. Device according to claim 1, wherein said tongues (111, 112) are connected to said male element by hinge elements (5).

6. Device according to claim 1, wherein said female element (2) has at least one cutout (122) configured to indicate the maximum backward condition or the maximum forward condition of said slider (3).

7. Device for releasably connecting a first element to a second element, the first and the second elements being alternately connectable and disconnectable, comprising:

a male element (1) connectable to one end of said first element, such that when said male element (1) is inserted into a female element (2) connectable to one end of said second element, said male element (1) and said female element (2) pass from a disengagement condition to a mutual engagement condition; and a slider (3) activating/deactivating said engagement condition, said slider (3) being engaged to said male element (1) to slide along a direction of insertion of said male element (2) inside said female element (2), wherein a relative motion between said slider (3) and said male element (1) is transmitted to first removable locking members, belonging to said male element (1) and cooperating with corresponding second locking members belonging to said female element (2), such to pass from a stable locking condition to a stable release condition of said male element (1) with said female element (2), wherein passage from the locking condition to the release condition is performed by an action moving said slider (3) in said direction of insertion, wherein said slider (3) passes from a maximum backward condition, corresponding to the release condition, to a maximum forward condition, corresponding to the locking condition, said slider comprising an elongated element (31), at an end faced towards said female element (2), has an enlarged head (32), such that said enlarged head (32), passing from a maximum backward condition to a maximum forward condition, pushes said first locking members towards inner walls of said female element (2), such that said first locking members engage the second locking members placed on the inner walls of said female element (2), wherein said male element (1) comprises a first bottom part (11) comprising at least two peripheral tongues (111, 112) and a central housing channel for slidably housing said slider (3), said male element (1) comprising a second cover part (12), which couples with said first bottom part (11) to allow said slider (3) to slidingly engage, and wherein first bottom part (11) is made as one piece and comprises a frame having a rear wall (119) from which two peripheral uprights (111, 112), two internal uprights (1110, 1120), and a central upright (113) extend, said peripheral uprights being configured to compose said two tongues (111,112), said central upright (113) being a guide element for sliding said slider (3), and said internal uprights (1110, 1120) having coupling seats for corresponding coupling teeth (121, 123) belonging to said second cover part (12).

* * * * *